US007179177B2

(12) United States Patent
Kennedy, III

(10) Patent No.: US 7,179,177 B2
(45) **Date of Patent: *Feb. 20, 2007**

(54) GOLF BALL WITH COVERED DIMPLES

(75) Inventor: Thomas J. Kennedy, III, Wilbraham, MA (US)

(73) Assignee: Callaway Golf Company, Carlsbad, CA (US)

( * ) Notice: Subject to any disclaimer, the term of this patent is extended or adjusted under 35 U.S.C. 154(b) by 166 days.

This patent is subject to a terminal disclaimer.

(21) Appl. No.: 10/905,096

(22) Filed: Dec. 15, 2004

(65) Prior Publication Data

US 2005/0090335 A1 Apr. 28, 2005

Related U.S. Application Data

(63) Continuation-in-part of application No. 10/900,692, filed on Jul. 27, 2004, now Pat. No. 6,964,623, which is a continuation of application No. 09/730,867, filed on Dec. 6, 2000, now Pat. No. 6,767,295.

(51) Int. Cl.
*A63B 37/14* (2006.01)

(52) U.S. Cl. ..... 473/383; 473/378

(58) Field of Classification Search ..... 473/351–384
See application file for complete search history.

(56) References Cited

U.S. PATENT DOCUMENTS 1,286,834 A 12/1918 Taylor
1,795,732 A 3/1931 Miller
2,002,726 A 5/1935 Young
4,266,773 A 5/1981 Treadwell
4,722,529 A 2/1988 Shaw et al.
4,787,638 A 11/1988 Kobayashi
4,830,378 A 5/1989 Aoyama
4,836,552 A 6/1989 Puckett et al.
5,143,377 A 9/1992 Oka et al.
5,174,578 A 12/1992 Oka et al.
5,338,039 A 8/1994 Oka et al.
5,356,150 A 10/1994 Lavallee et al.
5,377,989 A 1/1995 Machin
5,470,076 A 11/1995 Cadorniga
5,503,398 A 4/1996 Lu
5,536,013 A 7/1996 Pocklington
5,695,414 A 12/1997 Yokota
5,722,903 A 3/1998 Moriyama et al.
5,800,287 A 9/1998 Yokota et al.
5,842,937 A 12/1998 Dalton et al.
5,857,924 A 1/1999 Miyagawa et al.
D406,623 S 3/1999 Stiefel
5,890,975 A 4/1999 Stiefel (Continued)

*Primary Examiner*—Eugene Kim
*Assistant Examiner*—Alvin A. Hunter, Jr.
(74) *Attorney, Agent, or Firm*—Michael A. Catania; Elaine H. Lo

(57) ABSTRACT

A golf ball (20) having a plurality of standard dimples (33) and a plurality of covered dimples (31) is disclosed herein. Each of the plurality of covered dimples (31) has at least one overhang land area portion (50) that covers a portion of a concavity (55) of the covered dimple (31). A covered region (70) under the overhang land area portion (50) generates eddy currents during the flight of the golf ball (20) which creates greater turbulence at the surface (22) of the golf ball (20) allowing for greater distance.

20 Claims, 9 Drawing Sheets

U.S. PATENT DOCUMENTS

| | | | | |
|---|---|---|---|---|
| 5,916,044 | A | 6/1999 | Shimosaka et al. | |
| 6,176,793 | B1 | 1/2001 | Sullivan et al. | |
| 6,290,615 | B1 | 9/2001 | Ogg | |
| 6,503,158 | B2 | 1/2003 | Murphy et al. | |
| 6,616,553 | B1 | 9/2003 | Tavares | |
| 6,626,772 | B1 | 9/2003 | Kennedy, III | |
| 6,767,295 | B2 * | 7/2004 | Kennedy, III | 473/383 |
| 6,964,623 | B2 * | 11/2005 | Kennedy, III | 473/383 |

* cited by examiner

GOLF BALL WITH COVERED DIMPLES

CROSS REFERENCES TO RELATED APPLICATIONS

This application is a continuation-in-part application of U.S. patent application Ser. No. 10/900,692, filed Jul. 27, 2004 now U.S. Pat. No. 6,964,623, which is a continuation application of U.S. patent application Ser. No. 09/730,867 filed Dec. 6, 2000 now U.S. Pat. No. 6,767,295.

BACKGROUND OF THE INVENTION

1. Field of the Invention

The present invention relates to an aerodynamic surface geometry for a golf ball. More specifically, the present invention relates to a golf ball having a plurality of covered dimples.

2. Description of the Related Art

Golfers realized perhaps as early as the 1800's that golf balls with indented surfaces flew better than those with smooth surfaces. Hand-hammered gutta-percha golf balls could be purchased at least by the 1860's, and golf balls with brambles (bumps rather than dents) were in style from the late 1800's to 1908. In 1908, an Englishman, William Taylor, received a British patent for a golf ball with indentations (dimples) that flew better and more accurately than golf balls with brambles. A.G. Spalding & Bros., purchased the U.S. rights to the patent (embodied possibly in U.S. Pat. No. 1,286,834 issued in 1918) and introduced the GLORY ball featuring the TAYLOR dimples. Until the 1970s, the GLORY ball, and most other golf balls with dimples had 336 dimples of the same size using the same pattern, the ATTI pattern. The ATTI pattern was an octahedron pattern, split into eight concentric straight line rows, which was named after the main producer of molds for golf balls.

The only innovation related to the surface of a golf ball during this sixty year period came from Albert Penfold who invented a mesh-pattern golf ball for Dunlop. This pattern was invented in 1912 and was accepted until the 1930's. A combination of a mesh pattern and dimples is disclosed in Young, U.S. Pat. No. 2,002,726, for a Golf Ball, which issued in 1935.

The traditional golf ball, as readily accepted by the consuming public, is spherical with a plurality of dimples, with each dimple having a circular cross-section. Many golf balls have been disclosed that break with this tradition, however, for the most part these non-traditional golf balls have been commercially unsuccessful.

Most of these non-traditional golf balls still attempt to adhere to the Rules Of Golf as set forth by the United States Golf Association ("USGA" and The Royal and Ancient Golf Club of Saint Andrews ("R&A"). As set forth in Appendix III of the Rules of Golf, the weight of the ball shall not be greater than 1.620 ounces avoirdupois (45.93 gm), the diameter of the ball shall be not less than 1.680 inches (42.67 mm) which is satisfied if, under its own weight, a ball falls through a 1.680 inches diameter ring gauge in fewer than 25 out of 100 randomly selected positions, the test being carried out at a temperature of 23±1° C., and the ball must not be designed, manufactured or intentionally modified to have properties which differ from those of a spherically symmetrical ball.

One example is Shimosaka et al., U.S. Pat. No. 5,916,044, for a Golf Ball that discloses the use of protrusions to meet the 1.68 inch (42.67 mm) diameter limitation of the USGA and R&A. The Shimosaka patent discloses a golf ball with a plurality of dimples on the surface and a few rows of protrusions that have a height of 0.001 to 1.0 mm from the surface. Thus, the diameter of the land area is less than 42.67 mm.

Another example of a non-traditional golf ball is Puckett et al., U.S. Pat. No. 4,836,552 for a Short Distance Golf Ball, which discloses a golf ball having brambles instead of dimples in order to reduce the flight distance to half of that of a traditional golf ball in order to play on short distance courses.

Another example of a non-traditional golf ball is Pocklington, U.S. Pat. No. 5,536,013 for a Golf Ball, which discloses a golf ball having raised portions within each dimple, and also discloses dimples of varying geometric shapes, such as squares, diamonds and pentagons. The raised portions in each of the dimples of Pocklington assist in controlling the overall volume of the dimples.

Another example is Kobayashi, U.S. Pat. No. 4,787,638 for a Golf Ball, which discloses a golf ball having dimples with indentations within each of the dimples. The indentations in the dimples of Kobayashi are to reduce the air pressure drag at low speeds in order to increase the distance.

Yet another example is Treadwell, U.S. Pat. No. 4,266,773 for a Golf Ball, which discloses a golf ball having rough bands and smooth bands on its surface in order to trip the boundary layer of air flow during flight of the golf ball.

Aoyama, U.S. Pat. No. 4,830,378, for a Golf Ball With Uniform Land Configuration, discloses a golf ball with dimples that have triangular shapes. The total land area of Aoyama is no greater than 20% of the surface of the golf ball, and the objective of the patent is to optimize the uniform land configuration and not the dimples.

Another variation in the shape of the dimples is set forth in Steifel, U.S. Pat. No. 5,890,975 for a Golf Ball And Method Of Forming Dimples Thereon. Some of the dimples of Steifel are elongated to have an elliptical cross-section instead of a circular cross-section. The elongated dimples make it possible to increase the surface coverage area. A design patent to Steifel, U.S. Pat. No. 406,623, has all elongated dimples.

A variation on this theme is set forth in Moriyama et al., U.S. Pat. No. 5,722,903, for a Golf Ball, which discloses a golf ball with traditional dimples and oval-shaped dimples.

A further example of a non-traditional golf ball is set forth in Shaw et al., U.S. Pat. No. 4,722,529, for Golf Balls, which discloses a golf ball with dimples and 30 bald patches in the shape of a dumbbell for improvements in aerodynamics.

Another example of a non-traditional golf ball is Cadorniga, U.S. Pat. No. 5,470,076, for a Golf Ball, which discloses each of a plurality of dimples having an additional recess. It is believed that the major and minor recess dimples of Cadorniga create a smaller wake of air during flight of a golf ball.

Oka et al., U.S. Pat. No. 5,143,377, for a Golf Ball, discloses circular and non-circular dimples. The non-circular dimples are square, regular octagonal and regular hexagonal. The non-circular dimples amount to at least forty percent of the 332 dimples on the golf ball. These non-circular dimples of Oka have a double slope that sweeps air away from the periphery in order to make the air turbulent.

Machin, U.S. Pat. No. 5,377,989, for Golf Balls With Isodiametrical Dimples, discloses a golf ball having dimples with an odd number of curved sides and arcuate apices to reduce the drag on the golf ball during flight.

Lavallee et al., U.S. Pat. No. 5,356,150, discloses a golf ball having overlapping elongated dimples to obtain maximum dimple coverage on the surface of the golf ball.

Oka et al., U.S. Pat. No. 5,338,039, discloses a golf ball having at least forty percent of its dimples with a polygonal shape. The shapes of the Oka golf ball are pentagonal, hexagonal and octagonal.

Sullivan, et al., U.S. Pat. No. 6,176,793 for a Golf Ball With Contoured Dimples discloses a golf ball with dimples that have a portion of the bottom surface with a raised contour to reduce drag and increase distance.

Ogg, U.S. Pat. No. 6,290,615 for a Golf Ball Having A Tubular Lattice Pattern discloses a golf ball with a non-dimple aerodynamic pattern.

The HX® RED golf ball and the HX® BLUE golf ball from Callaway Golf Company of Carlsbad, Calif. are golf balls with non-dimple aerodynamic patterns. The aerodynamic patterns generally consist of a tubular lattice network that defines hexagons and pentagons on the surface of the golf ball. Each hexagon is generally defined by thirteen facets, six of the facets being shared facets and seven of the facets been internal facets.

Murphy et al., U.S. Pat. No. 6,503,158 for a Dual Non-Circular Dimple For Golf Balls discloses a golf ball with compound dimples that have a first non-circular portion and a deeper second non-circular portion.

Tavares, U.S. Pat. No. 6,616,552 for a Non-Symmetric Dimple Depth Profile discloses a golf ball having dimples that have a portion of the bottom surface extending below a radius of curvature which defines the concavity of the dimple.

Kennedy, III, U.S. Pat. No. 6,626,772 for a Golf Ball With Elevated Dimple Portions discloses a golf ball having dimples with an annular portion that is elevated above the spherical surface of the golf ball.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF SUMMARY OF THE INVENTION

The golf ball of the present invention increases the turbulence of air at the surface of the golf ball in order to reduce laminar flow resulting in less drag on the golf ball during flight, which results in greater distance when struck by a golf club.

One aspect of the present invention is a golf ball having a surface thereon, the golf ball having a plurality of covered dimples and a plurality of standard dimples. Each of the plurality of covered dimples has at least one overhang land area portion covering a portion of a concavity of the covered dimple. Each of the standard dimples has an entirely exposed concavity.

When the face of a golf club strikes the golf ball, each of the impacted overhang land area portions of the covered dimples is momentarily compressed by the impact of the face of the golf club. Once the golf ball leaves the face, each of the overhang land area portions springs back to a pre-impact configuration which allows the covered concavity area of each covered dimple to increase turbulence at the surface of the golf ball.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
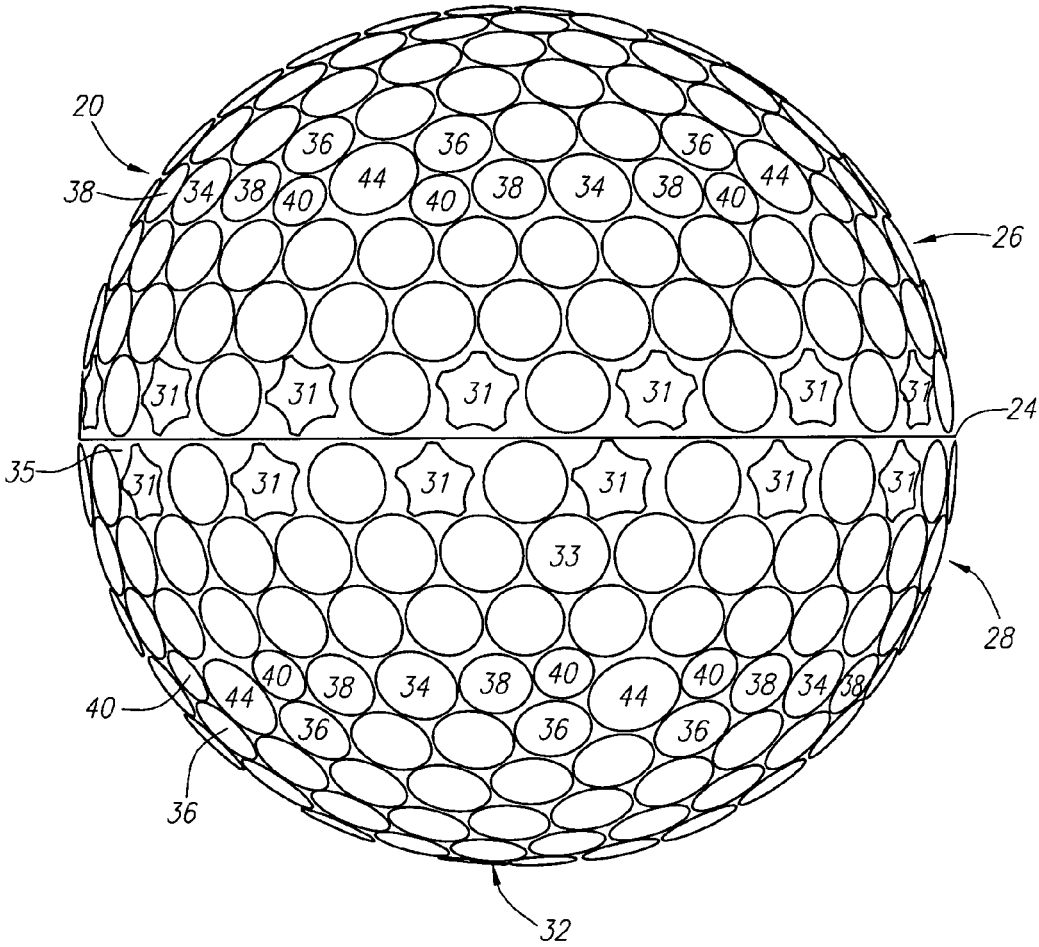
FIG. 1 is an equatorial view of a preferred embodiment of a golf ball.

As shown in FIGS. 1–5, a golf ball is generally designated 20. The golf ball 20 may be a two-piece golf ball, a three-piece golf ball, or a greater multi-layer golf ball. The construction of the golf ball is discussed in greater detail below.

As shown in FIGS. 1–4, the golf ball 20 has a surface 22. The golf ball 20 preferably has an equator 24 dividing the golf ball 20 into a first hemisphere 26 and a second hemisphere 28. A first pole 30 of the golf ball 20 is located ninety degrees along a longitudinal arc from the equator 24 in the first hemisphere 26. A second pole 32 of the golf ball 20 is located ninety degrees along a longitudinal arc from the equator 24 in the second hemisphere 28.

On the surface 22 of the golf ball 20 are a plurality of covered dimples 31, a plurality of standard dimples 33 and land area 35. Each of the plurality of covered dimples 31 has at least one overhang land area portion 50. The overhang land area portion 50 extends from the land area 35 over a portion of a concavity 55 of the covered dimple 31. In a preferred embodiment, each of the plurality of covered dimples 31 has from 1 to 9 overhand land area portions 50, more preferably from 3 to 7 overhang land area portions 50, and most preferably 5 overhang land area portions 50. Each of the overhang land area portions covers a covered region 70 of the covered dimple 31. During flight of the golf ball 20, eddy currents are preferably generated in the covered region 70 of the covered dimple 31, which increase the turbulence at the surface 22 of the golf ball resulting in greater distance.

In a preferred embodiment, a plurality of overhang land area portions cover from 5% to 60% of the surface area of the concavity 55 of the covered dimple 31, more preferably from 10% to 20% of the surface area of the concavity 55 of the covered dimple 31, and most preferably 15% of the surface area of the concavity 55 of the covered dimple 31.

In a preferred embodiment, as shown in FIGS. 8–12, each of the overhang land portions 50 extends between 0.025 millimeters to 1.0 millimeters from a phantom edge 59 of each of the plurality of covered dimples 31 to a farthest extent 57 of the overhand land area portion 50. In a most preferred embodiment, each of the overhang land area portions 50 extends 0.3 millimeters from the phantom edge 59 of the covered dimple 31 to a farthest extent 57 of the overhand land area portion 50.

Figure 10:
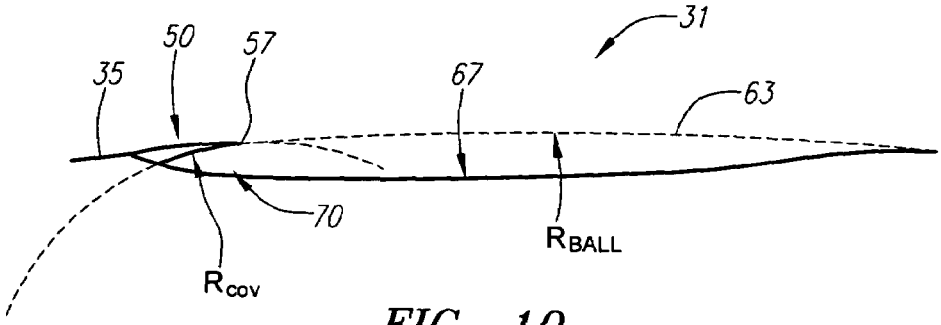
FIG. 10 is a cross-sectional view of a preferred embodiment of a covered dimple illustrating the radius of the ball and the radius of curvature of the internal surface of the overhang land area portion.
Figure 11:
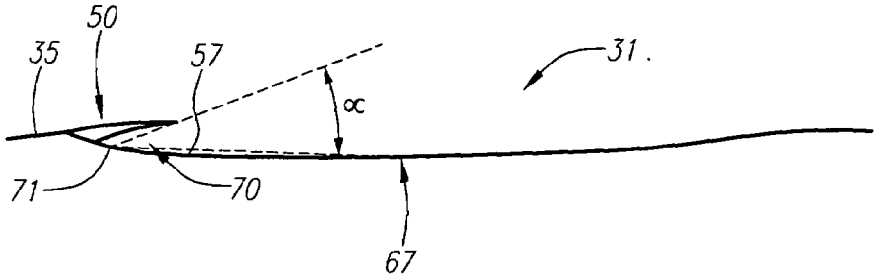
FIG. 11 is a cross-section view of an alternative embodiment of a covered dimple illustrating a straight or flat internal surface of the overhang land area portion.
Figure 12:
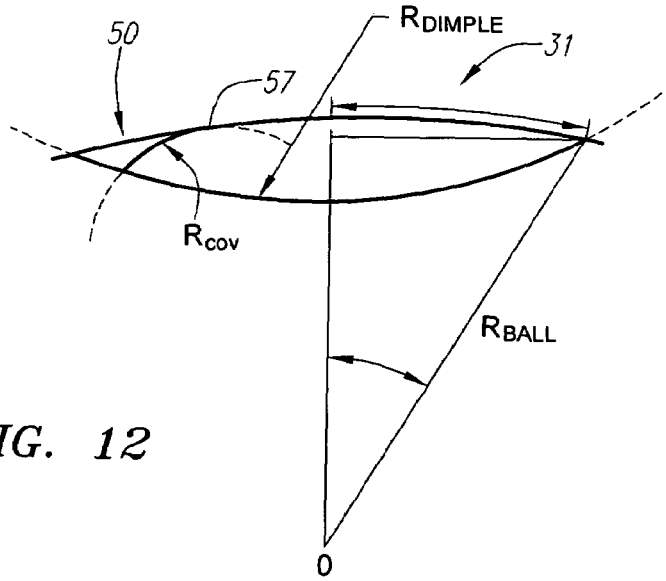
FIG. 12 is yet another alternative embodiment of a covered dimple illustrating the radius of curvature of a concavity of the covered dimple.

In a preferred embodiment shown in FIGS. 10 and 12, the internal surface of the overhang land area portion 50 is defined by a radius of curvature that has a radius Rcov which is smaller than the radius of the golf ball 20, preferably approximately 0.84 inch, and smaller than the radius of the surface of the dimple 31, Rdimple-con, as shown in FIG. 12. Alternatively, as shown in FIG. 11, the internal surface of the overhang land area portion 50 is a straight line from farthest extent point 57 to a concavity edge 71. An angle a is defined by the internal surface of the overhang land area portion 50 and a line from the concavity edge 71 to a center 67 of the bottom surface of the concavity 55. The angle $\alpha$ is preferably acute, and most preferably ranges from 30 degrees to 85 degrees, and more preferably from 40 degrees to 50 degrees.

Figure 2:
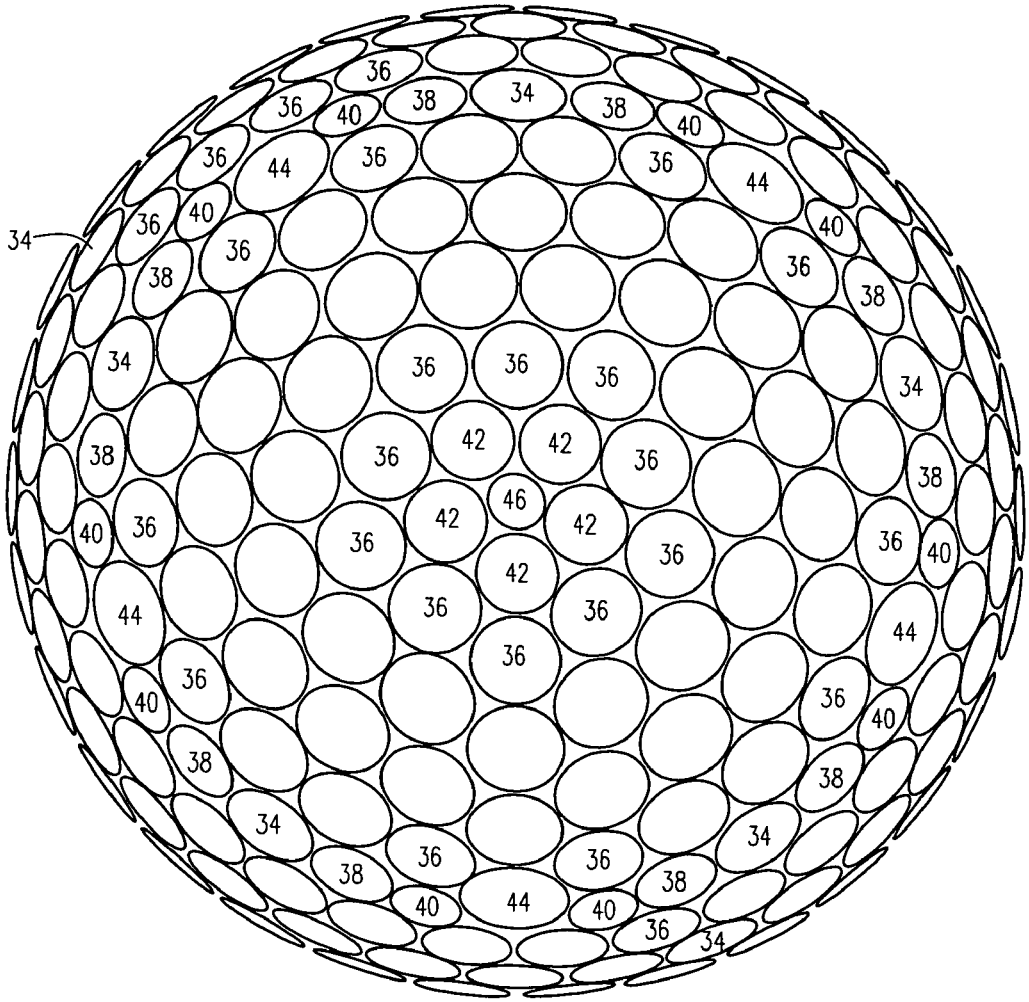
FIG. 2 is a polar view of the golf ball of FIG. 1.

In a preferred embodiment, as shown in FIGS. 1 and 2, the golf ball 20 has 382 total dimples, which includes the plurality of covered dimples 31 and the plurality of standard dimples 33. In a preferred embodiment, the 382 dimples account for 86% of the surface area 22 of the golf ball 20.

In the embodiment shown in FIGS. 1 and 2, the plurality of covered dimples numbers 56. The plurality of standard dimples 33 preferably is partitioned into seven different sets of dimples. A first set of dimples 34 are the most numerous dimples, preferably consisting of one hundred sixty-four dimples in the preferred embodiment. A second set of dimples 36 are the next most numerous dimples preferably consisting of one-hundred dimples. A third set of dimples 38 and a fourth set of dimples 40 are the next most numerous with each set 38 and 40 preferably consisting of twenty dimples in the preferred embodiment. A fifth set of dimples 42 and a sixth set of dimples 44 are the next most numerous with each set 42 and 44 preferably consisting of ten dimples in the preferred embodiment. The seventh set of dimples 46 preferably consist of only two dimples.

The two dimples of the seventh set of dimples 46 are each preferably disposed on respective poles 30 and 32. Each of the fifth set of dimples 42 is preferably adjacent one of the seventh set of dimples 46. The five dimples of the fifth set of dimples 42 that are disposed within the first hemisphere 26 are each preferably an equal distance from the equator 24 and the first pole 30. The five dimples of the fifth set of dimples 42 that are disposed within the second hemisphere 28 are each preferably an equal distance from the equator 24 and the second pole 32.

Figure 3:
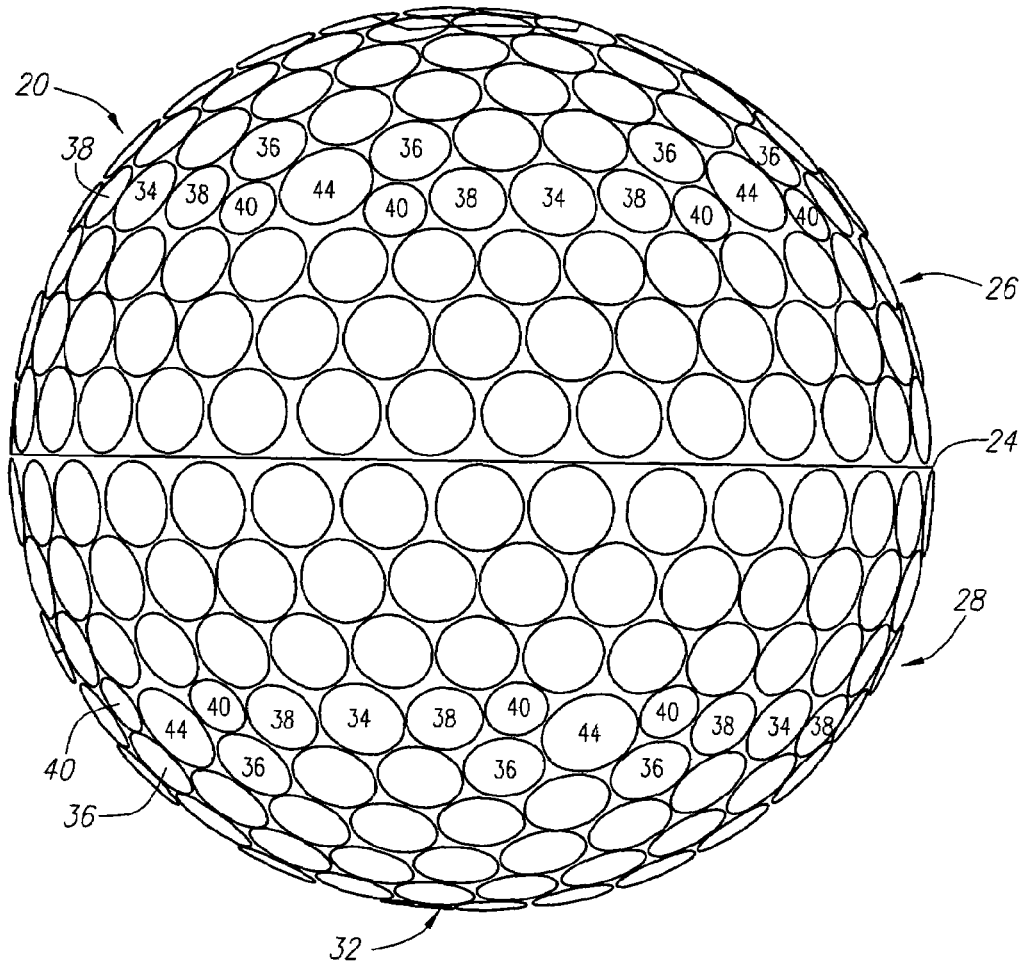
FIG. 3 is an equatorial view of an alternative embodiment of a golf ball.
Figure 4:
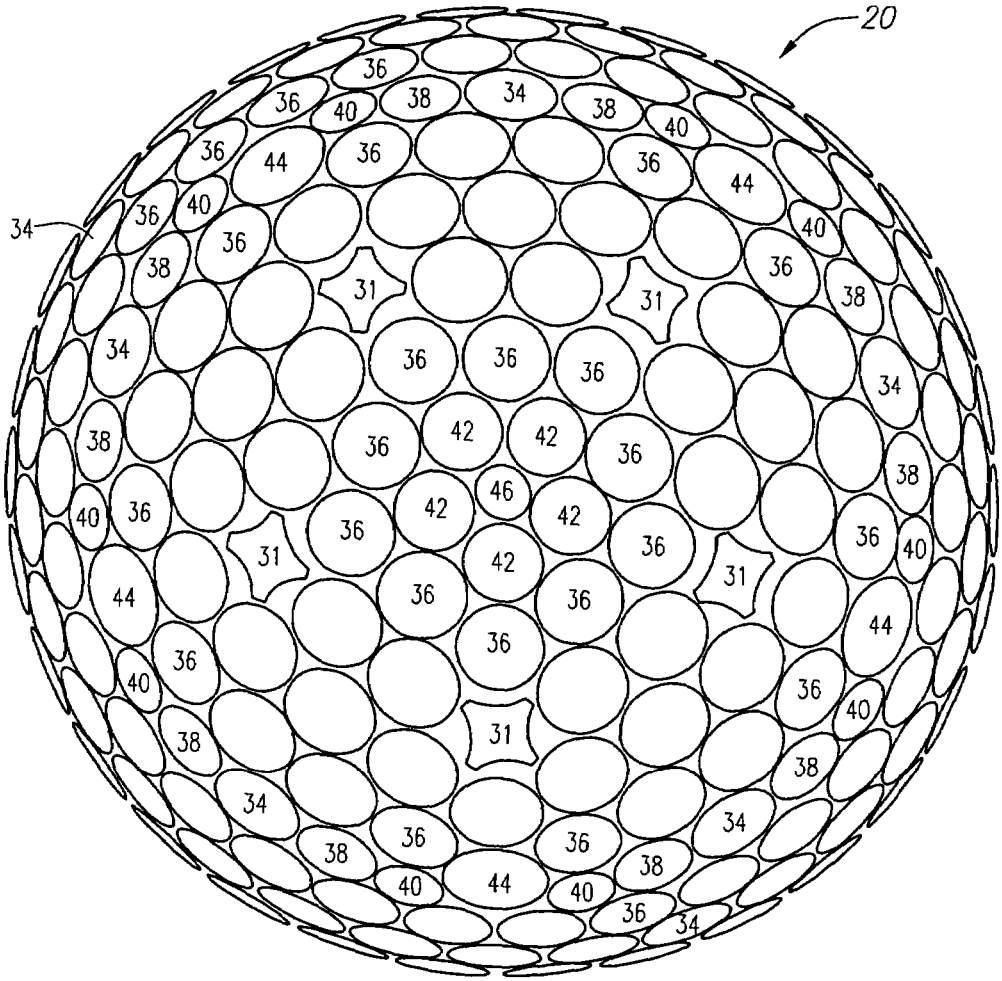
FIG. 4 is a polar view of the golf ball of FIG. 3.

The embodiment of FIGS. 3 and 4 is similar to the embodiment of FIGS. 1 and 2, however, the plurality of covered dimples 31 numbers 10, with the plurality of standard dimples numbering 372.

Figure 6:
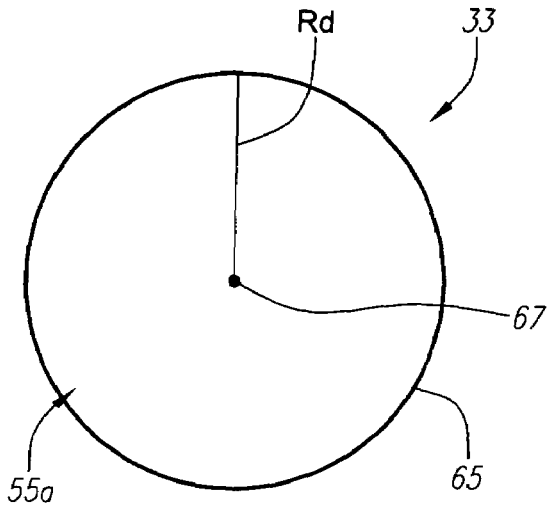
FIG. 6 is an isolated top plan view of a standard dimple.
Figure 7:
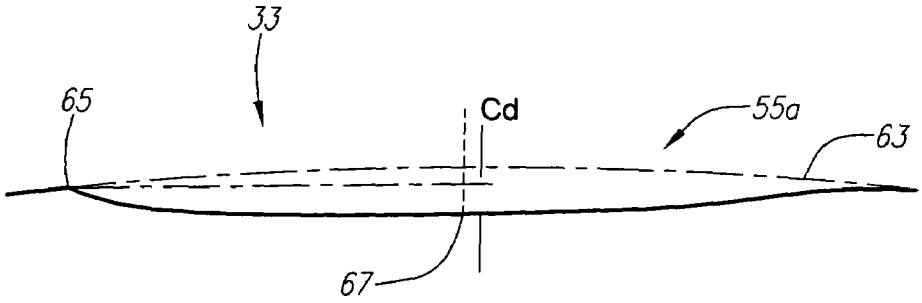
FIG. 7 is a cross-sectional view of a standard dimple.
Figure 8:
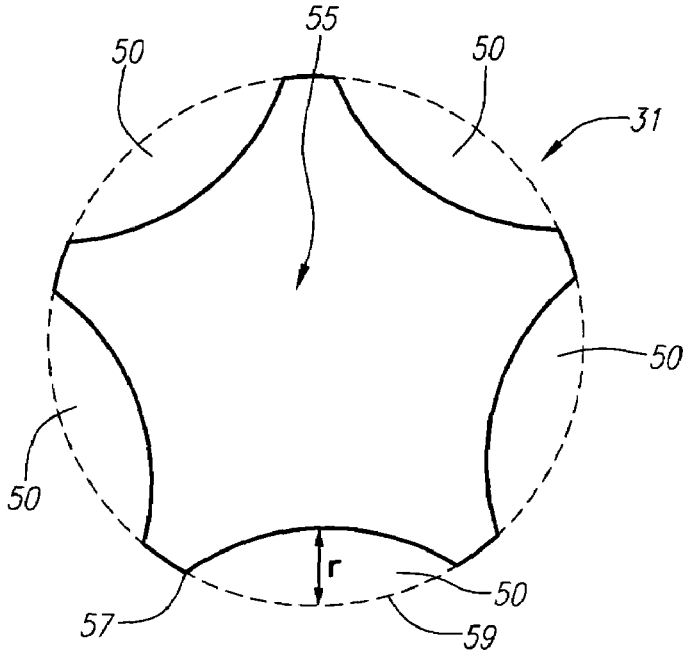
FIG. 8 is an isolated top plan view of a preferred embodiment of a covered dimple.
Figure 9:
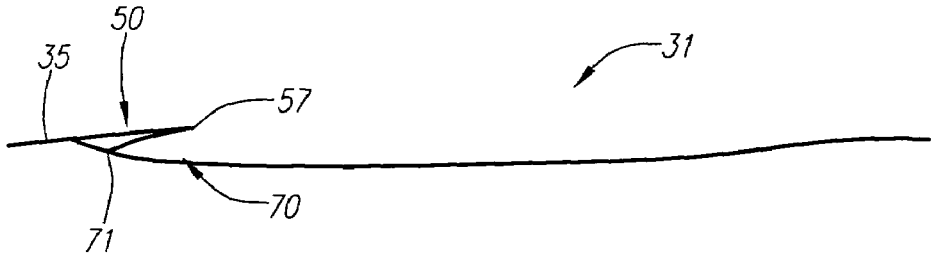
FIG. 9 is a cross-sectional view of a preferred embodiment of a covered dimple.

FIGS. 6 and 7 illustrate a standard dimple 33. The radius of the dimple, "Rd", is defined as the radius from an actual edge 65 of the dimple 33 to a line perpendicular to the center 67 of the dimple 33. The chord depth, "Cd", is defined as the depth of the dimple at the center 67 from a line parallel to the edge 65. The radius of the dimple 42 is approximately 0.0720 inch and the chord depth is approximately 0.0054 inch. The radius of the dimple 46 is approximately 0.0510 inch and the chord depth is approximately 0.0049 inch. The radius of the dimple 44 is approximately 0.0930 inch and the chord depth is approximately 0.0051 inch. The radius of the dimple 40 is approximately 0.062 inch and the chord depth is approximately 0.0052 inch. The radius of the dimple 38 is approximately 0.074 inch and the chord depth is approximately 0.0053 inch. The radius of the dimple 34 is approximately 0.0834 inch and the chord depth is approximately 0.0053 inch. The radius of the dimple 36 is approximately 0.079 inch and the chord depth is approximately 0.0053 inch.

Figure 5:
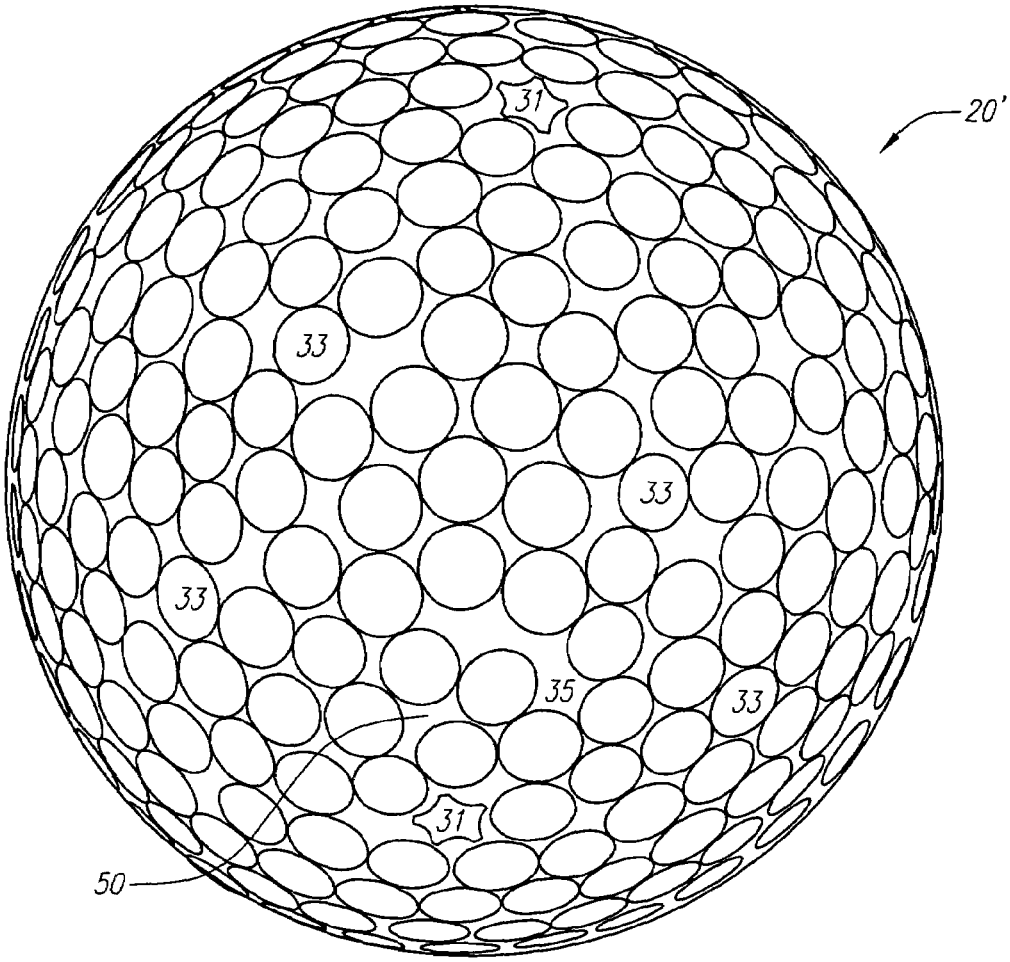
FIG. 5 is a polar view of an alternative embodiment of a golf ball.

FIG. 5 is an alternative embodiment of a dimple pattern utilizing covered dimples. Such a pattern is disclosed in U.S. Pat. No. 5,772,532 for a Golf Ball, which is assigned to the assignee of the present application, and which is hereby incorporated by reference in its entirety.

Figure 13:
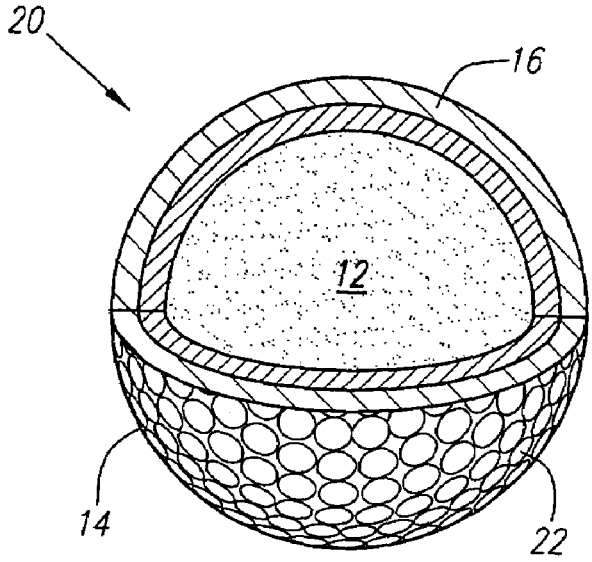
FIG. 13 is a cut-away view of the construction of a preferred embodiment of a solid three-piece golf ball.
Figure 14:
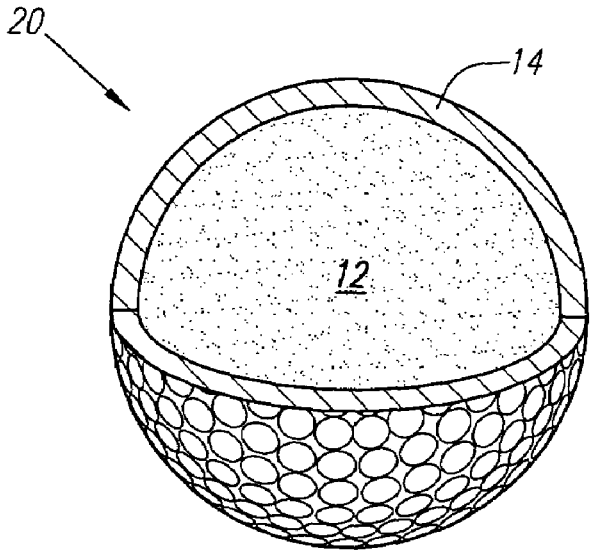
FIG. 14 is a cut-away view of the construction of a preferred embodiment of a solid two-piece golf ball.

A preferred construction of the golf ball 20 is shown in reference to FIGS. 13 and 14. In one embodiment, the golf ball 20 is constructed as set forth in U.S. Pat. No. 6,117,024, for a Golf Ball With A Polyurethane Cover, which pertinent parts are hereby incorporated by reference. The golf ball 20 has a coefficient of restitution at 143 feet per second greater than 0.7964, and an USGA initial velocity less than 255.0 feet per second. The preferred golf ball 20 has a COR of approximately 0.8152 at 143 feet per second, and an initial velocity between 250 feet per second to 255 feet per second under USGA initial velocity conditions. A more thorough description of a high COR golf ball is disclosed in U.S. Pat. No. 6,443,858, which pertinent parts are hereby incorporated by reference.

Additionally, the core of the golf ball 20 may be solid, hollow, or filled with a fluid, such as a gas or liquid, or have a metal mantle. The cover of the golf ball 20 may be any suitable material. A preferred cover for a three-piece golf ball is composed of a thermoset polyurethane material. Alternatively, the cover may be composed of a thermoplastic polyurethane, ionomer blend, ionomer rubber blend, ionomer and thermoplastic polyurethane blend, or like materials. A preferred cover material for a two-piece golf ball is a blend of ionomers. Alternatively, the golf ball 20 may have a thread layer. Those skilled in the pertinent art will recognize that other cover materials may be utilized without departing from the scope and spirit of the present invention. The golf ball 20 may have a finish of one or two basecoats and/or one or two top coats.

In an alternative embodiment of a golf ball 20, the boundary layer 16 or cover layer 14 is comprised of a high acid (i.e. greater than 16 weight percent acid) ionomer resin or high acid ionomer blend. More preferably, the boundary layer 16 is comprised of a blend of two or more high acid (i.e. greater than 16 weight percent acid) ionomer resins neutralized to various extents by different metal cations.

In an alternative embodiment of a golf ball 20, the boundary layer 16 or cover layer 14 is comprised of a low acid (i.e. 16 weight percent acid or less) ionomer resin or low acid ionomer blend. Preferably, the boundary layer 16 is comprised of a blend of two or more low acid (i.e. 16 weight percent acid or less) ionomer resins neutralized to various extents by different metal cations. The boundary layer 16 compositions of the embodiments described herein may include the high acid ionomers such as those developed by E. I. DuPont de Nemours & Company under the SURLYN brand, and by Exxon Corporation under the ESCOR or IOTEK brands, or blends thereof. Examples of compositions which may be used as the boundary layer 16 herein are set forth in detail in U.S. Pat. No. 5,688,869, which is incorporated herein by reference. Of course, the boundary layer 16 high acid ionomer compositions are not limited in any way to those compositions set forth in said patent. Those compositions are incorporated herein by way of examples only.

The high acid ionomers which may be suitable for use in formulating the boundary layer 16 compositions are ionic copolymers which are the metal (such as sodium, zinc, magnesium, etc.) salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (for example, iso- or n-butylacrylate, etc.) can also be included to produce a softer terpolymer. The carboxylic acid groups of the copolymer are partially neutralized (for example, approximately 10–100%, preferably 30–70%) by the metal ions. Each of the high acid ionomer resins which may be included in the inner layer cover compositions of the invention contains greater than 16% by weight of a carboxylic acid, preferably from about 17% to about 25% by weight of a carboxylic acid, more preferably from about 18.5% to about 21.5% by weight of a carboxylic acid. Examples of the high acid methacrylic acid based ionomers found suitable for use in accordance with this invention include, but are not limited to, SURLYN 8220 and 8240 (both formerly known as forms of SURLYN AD-8422), SURLYN 9220 (zinc cation), SURLYN SEP-503-1 (zinc cation), and SURLYN SEP-503-2 (magnesium cation). According to DuPont, all of these ionomers contain from about 18.5 to about 21.5% by weight methacrylic acid. Examples of the high acid acrylic acid based ionomers suitable for use in the present invention also include, but are not limited to, the high acid ethylene acrylic acid ionomers produced by Exxon such as Ex 1001, 1002, 959, 960, 989, 990, 1003, 1004, 993, and 994. In this regard, ESCOR or IOTEK 959 is a sodium ion neutralized ethylene-acrylic neutralized ethylene-acrylic acid copolymer. According to Exxon, IOTEKS 959 and 960 contain from about 19.0 to about 21.0% by weight acrylic acid with approximately 30 to about 70 percent of the acid groups neutralized with sodium and zinc ions, respectively.

Furthermore, as a result of the previous development by the assignee of this application of a number of high acid ionomers neutralized to various extents by several different types of metal cations, such as by manganese, lithium, potassium, calcium and nickel cations, several high acid ionomers and/or high acid ionomer blends besides sodium, zinc and magnesium high acid ionomers or ionomer blends are also available for golf ball cover production. It has been found that these additional cation neutralized high acid ionomer blends produce boundary layer 16 compositions exhibiting enhanced hardness and resilience due to synergies which occur during processing. Consequently, these metal cation neutralized high acid ionomer resins can be blended to produce substantially higher C.O.R.'s than those produced by the low acid ionomer boundary layer 16 compositions presently commercially available.

More particularly, several metal cation neutralized high acid ionomer resins have been produced by the assignee of this invention by neutralizing, to various extents, high acid copolymers of an alpha-olefin and an alpha, beta-unsaturated carboxylic acid with a wide variety of different metal cation salts. This discovery is the subject matter of U.S. Pat. No. 5,688,869, incorporated herein by reference. It has been found that numerous metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (for example, from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred.

The softening comonomer that can be optionally included in the boundary layer 16 of the golf ball of the invention may be selected from the group consisting of vinyl esters of aliphatic carboxylic acids wherein the acids have 2 to 10 carbon atoms, vinyl ethers wherein the alkyl groups contain 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 39 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

The boundary layer 16 compositions may include the low acid ionomers such as those developed and sold by E. I. DuPont de Nemours & Company under the SURLYN and by Exxon Corporation under the brands ESCOR and IOTEK, ionomers made in-situ, or blends thereof.

Another embodiment of the boundary layer 16 comprises a non-ionomeric thermoplastic material or thermoset material. Suitable non-ionomeric materials include, but are not limited to, metallocene catalyzed polyolefins or polyamides, polyamide/ionomer blends, polyphenylene ether/ionomer blends, etc., which preferably have a Shore D hardness of at least 60 (or a Shore C hardness of at least about 90) and a flex modulus of greater than about 30,000 psi, preferably greater than about 50,000 psi, or other hardness and flex modulus values which are comparable to the properties of the ionomers described above. Other suitable materials include but are not limited to, thermoplastic or thermosetting polyurethanes, thermoplastic block polyesters, for example, a polyester elastomer such as that marketed by DuPont under the brand HYTREL, or thermoplastic block polyamides, for example, a polyether amide such as that marketed by Elf Atochem S. A. under the brand PEBEX, a blend of two or more non-ionomeric thermoplastic elastomers, or a blend of one or more ionomers and one or more non-ionomeric thermoplastic elastomers. These materials can be blended with the ionomers described above in order to reduce cost relative to the use of higher quantities of ionomer.

Additional materials suitable for use in the boundary layer 16 or cover layer 14 of the present invention include polyurethanes. These are described in more detail below.

In one embodiment, the cover layer 14 is comprised of a relatively soft, low flex modulus (about 500 psi to about 50,000 psi, preferably about 1,000 psi to about 25,000 psi, and more preferably about 5,000 psi to about 20,000 psi) material or blend of materials. Preferably, the cover layer 14 comprises a polyurethane, a polyurea, a blend of two or more polyurethanes/polyureas, or a blend of one or more ionomers or one or more non-ionomeric thermoplastic materials with a polyurethane/polyurea, preferably a thermoplastic polyurethane or reaction injection molded polyurethane/polyurea (described in more detail below).

The cover layer 14 preferably has a thickness in the range of 0.005 inch to about 0.15 inch, more preferably about 0.010 inch to about 0.050 inch, and most preferably 0.015 inch to 0.025 inch. In one embodiment, the cover layer 14 has a Shore D hardness of 60 or less (or less than 90 Shore C), and more preferably 55 or less (or about 80 Shore C or less). In another preferred embodiment, the cover layer 14 is comparatively harder than the boundary layer 16.

In one preferred embodiment, the cover layer 14 comprises a polyurethane, a polyurea or a blend of polyurethanes/polyureas. Polyurethanes are polymers which are used to form a broad range of products. They are generally formed by mixing two primary ingredients during processing. For the most commonly used polyurethanes, the two primary ingredients are a polyisocyanate (for example, 4,4'-diphenylmethane diisocyanate monomer ("MDI") and toluene diisocyanate ("TDI") and their derivatives) and a polyol (for example, a polyester polyol or a polyether polyol).

A wide range of combinations of polyisocyanates and polyols, as well as other ingredients, are available. Furthermore, the end-use properties of polyurethanes can be controlled by the type of polyurethane utilized, such as whether the material is thermoset (cross linked molecular structure not flowable with heat) or thermoplastic (linear molecular structure flowable with heat).

Cross linking occurs between the isocyanate groups (—NCO) and the polyol's hydroxyl end-groups (—OH). Cross linking will also occur between the $NH_2$ group of the amines and the NCO groups of the isocyanates, forming a polyurea. Additionally, the end-use characteristics of polyurethanes can also be controlled by different types of reactive chemicals and processing parameters. For example, catalysts are utilized to control polymerization rates. Depending upon the processing method, reaction rates can be very quick (as in the case for some reaction injection molding systems ("RIM")) or may be on the order of several hours or longer (as in several coating systems such as a cast system). Consequently, a great variety of polyurethanes are suitable for different end-uses.

Polyurethanes are typically classified as thermosetting or thermoplastic. A polyurethane becomes irreversibly "set" when a polyurethane prepolymer is cross linked with a polyfunctional curing agent, such as a polyamine or a polyol. The prepolymer typically is made from polyether or polyester. A prepolymer is typically an isocyanate terminated polymer that is produced by reacting an isocyanate with a moiety that has active hydrogen groups, such as a polyester and/or polyether polyol. The reactive moiety is a hydroxyl group. Diisocyanate polyethers are preferred because of their water resistance.

The physical properties of thermoset polyurethanes are controlled substantially by the degree of cross linking and by the hard and soft segment content. Tightly cross linked polyurethanes are fairly rigid and strong. A lower amount of cross linking results in materials that are flexible and resilient. Thermoplastic polyurethanes have some cross linking, but primarily by physical means, such as hydrogen bonding. The crosslinking bonds can be reversibly broken by increasing temperature, such as during molding or extrusion. In this regard, thermoplastic polyurethanes can be injection molded, and extruded as sheet and blow film. They can be used up to about 400 degrees Fahrenheit, and are available in a wide range of hardness.

Polyurethane materials suitable for the present invention may be formed by the reaction of a polyisocyanate, a polyol, and optionally one or more chain extenders. The polyol component includes any suitable polyether- or polyester polyol. Additionally, in an alternative embodiment, the polyol component is polybutadiene diol. The chain extenders include, but are not limited to, diols, triols and amine extenders. Any suitable polyisocyanate may be used to form a polyurethane according to the present invention. The polyisocyanate is preferably selected from the group of diisocyanates including, but not limited to, 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI").

Other less preferred diisocyanates include, but are not limited to, isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis (isocyanato methyl) cyclohexane; and polymethylene polyphenyl isocyanate ("PMDI").

One additional polyurethane component which can be used in the present invention incorporates TMXDI ("META") aliphatic isocyanate (Cytec Industries, West Paterson, N.J.). Polyurethanes based on meta-tetramethylxylylene diisocyanate (TMXDI) can provide improved gloss retention UV light stability, thermal stability, and hydrolytic stability. Additionally, TMXDI ("META") aliphatic isocyanate has demonstrated favorable toxicological properties. Furthermore, because it has a low viscosity, it is usable with a wider range of diols (to polyurethane) and diamines (to polyureas). If TMXDI is used, it typically, but not necessarily, is added as a direct replacement for some or all of the other aliphatic isocyanates in accordance with the suggestions of the supplier. Because of slow reactivity of TMXDI, it may be useful or necessary to use catalysts to have practical demolding times. Hardness, tensile strength and elongation can be adjusted by adding further materials in accordance with the supplier's instructions.

The cover layer 14 preferably comprises a polyurethane with a Shore D hardness (plaque) of from about 10 to about 55 (Shore C of about 15 to about 75), more preferably from about 25 to about 55 (Shore C of about 40 to about 75), and most preferably from about 30 to about 55 (Shore C of about 45 to about 75) for a soft cover layer 14 and from about 20 to about 90, preferably about 30 to about 80, and more preferably about 40 to about 70 for a hard cover layer 14.

The polyurethane preferably has a flex modulus from about 1 to about 310 Kpsi, more preferably from about 3 to about 100 Kpsi, and most preferably from about 3 to about 40 Kpsi for a soft cover layer 14 and 40 to 90 Kpsi for a hard cover layer 14.

Non-limiting examples of a polyurethane suitable for use in the cover layer 14 (or boundary layer 16) include a thermoplastic polyester polyurethane such as Bayer Corporation's TEXIN polyester polyurethane (such as TEXIN DP7-1097 and TEXIN 285 grades) and a polyester polyurethane such as B. F. Goodrich Company's ESTANE polyester polyurethane (such as ESTANE X-4517 grade). The thermoplastic polyurethane material may be blended with a soft ionomer or other non-ionomer. For example, polyamides blend well with soft ionomer.

Other soft, relatively low modulus non-ionomeric thermoplastic or thermoset polyurethanes may also be utilized, as long as the non-ionomeric materials produce the playability and durability characteristics desired without adversely affecting the enhanced travel distance characteristic produced by the high acid ionomer resin composition. These include, but are not limited to thermoplastic polyurethanes such as the PELLETHANE thermoplastic polyurethanes from Dow Chemical Co.; and non-ionomeric thermoset polyurethanes including but not limited to those disclosed in U.S. Pat. No. 5,334,673 incorporated herein by reference.

Typically, there are two classes of thermoplastic polyurethane materials: aliphatic polyurethanes and aromatic polyurethanes. The aliphatic materials are produced from a polyol or polyols and aliphatic isocyanates, such as $H_{12}$MDI or HDI, and the aromatic materials are produced from a polyol or polyols and aromatic isocyanates, such as MDI or TDI. The thermoplastic polyurethanes may also be produced from a blend of both aliphatic and aromatic materials, such as a blend of HDI and TDI with a polyol or polyols.

Generally, the aliphatic thermoplastic polyurethanes are lightfast, meaning that they do not yellow appreciably upon exposure to ultraviolet light. Conversely, aromatic thermoplastic polyurethanes tend to yellow upon exposure to ultraviolet light. One method of stopping the yellowing of the aromatic materials is to paint the outer surface of the finished ball with a coating containing a pigment, such as titanium dioxide, so that the ultraviolet light is prevented from reaching the surface of the ball. Another method is to add UV absorbers, optical brighteners and stabilizers to the clear coating(s) on the outer cover, as well as to the thermoplastic polyurethane material itself. By adding UV absorbers and stabilizers to the thermoplastic polyurethane and the coating(s), aromatic polyurethanes can be effectively used in the outer cover layer of golf balls. This is advantageous because aromatic polyurethanes typically have better scuff resistance characteristics than aliphatic polyurethanes, and the aromatic polyurethanes typically cost less than the aliphatic polyurethanes.

Other suitable polyurethane materials for use in the present invention golf balls include reaction injection molded ("RIM") polyurethanes. RIM is a process by which highly reactive liquids are injected into a mold, mixed usually by impingement and/or mechanical mixing in an in-line device such as a "peanut mixer," where they polymerize primarily in the mold to form a coherent, one-piece molded article. The RIM process usually involves a rapid reaction between one or more reactive components such as a polyether polyol or polyester polyol, polyamine, or other material with an active hydrogen, and one or more isocyanate-containing constituents, often in the presence of a catalyst. The constituents are stored in separate tanks prior to molding and may be first mixed in a mix head upstream of a mold and then injected into the mold. The liquid streams are metered in the desired weight to weight ratio and fed into an impingement mix head, with mixing occurring under high pressure, for example, 1,500 to 3,000 psi. The liquid streams impinge upon each other in the mixing chamber of the mix head and the mixture is injected into the mold. One of the liquid streams typically contains a catalyst for the reaction. The constituents react rapidly after mixing to gel and form polyurethane polymers. Polyureas, epoxies, and various unsaturated polyesters also can be molded by RIM. Further descriptions of suitable RIM systems are disclosed in U.S. Pat. No. 6,663,508, which pertinent parts are hereby incorporated by reference.

Non-limiting examples of suitable RIM systems for use in the present invention are BAYFLEX elastomeric polyurethane RIM systems, BAYDUR GS solid polyurethane RIM systems, PRISM solid polyurethane RIM systems, all from Bayer Corp. (Pittsburgh, Pa.), SPECTRIM reaction moldable polyurethane and polyurea systems from Dow Chemical USA (Midland, Mich.), including SPECTRIM MM 373-A (isocyanate) and 373-B (polyol), and ELASTOLIT SR systems from BASF (Parsippany, N.J.). Preferred RIM systems include BAYFLEX MP-10000, BAYFLEX MP-7500 and BAYFLEX 110-50, filled and unfilled. Further preferred examples are polyols, polyamines and isocyanates formed by processes for recycling polyurethanes and polyureas. Additionally, these various systems may be modified by incorporating a butadiene component in the diol agent.

Another preferred embodiment is a golf ball in which at least one of the boundary layer 16 and/or the cover layer 14 comprises a fast-chemical-reaction-produced component. This component comprises at least one material selected from the group consisting of polyurethane, polyurea, polyurethane ionomer, epoxy, and unsaturated polyesters, and preferably comprises polyurethane, polyurea or a blend comprising polyurethanes and/or polymers. A particularly preferred form of the invention is a golf ball with a cover comprising polyurethane or a polyurethane blend.

The polyol component typically contains additives, such as stabilizers, flow modifiers, catalysts, combustion modifiers, blowing agents, fillers, pigments, optical brighteners, and release agents to modify physical characteristics of the cover. Polyurethane/polyurea constituent molecules that were derived from recycled polyurethane can be added in the polyol component.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf ball having a surface thereon, the golf ball comprising:

a plurality of covered dimples, each of the plurality of covered dimples having at least one overhang land area portion covering a portion of a concavity of the covered dimple; and a plurality of standard dimples, each of the standard dimples having an entirely exposed concavity.

2. The golf ball according to claim 1 wherein each of the plurality of covered dimples has a plurality of overhang land area portions.

3. The golf ball according to claim 2 wherein the plurality of overhang land area portions cover between 5% to 60% of the concavity of each of the plurality of covered dimples.

4. The golf ball according to claim 2 wherein the plurality of overhang land area portions cover between 10% to 15% of the concavity of each of the plurality of covered dimples.

5. The golf ball according to claim 2 wherein each of the plurality of overhang land area portions extends between 0.025 millimeters to 1.0 millimeters from a phantom edge of each of the plurality of covered dimples to a farthest extend of the overhand land area portion.

6. The golf ball according to claim 2 wherein an internal surface of each of the plurality of overhang land area portions of each of the plurality of covered dimples is defined by a radius of curvature $R_{cov}$ which is smaller than a radius of the golf ball, $R_{ball}$.

7. The golf ball according to claim 2 wherein an internal surface of each of the plurality of overhang land area portions of each of the plurality of covered dimples is defined by a radius of curvature $R_{cov}$ which is larger than a radius of the golf ball, $R_{ball}$.

8. The golf ball according to claim 2 wherein an internal surface of each of the plurality of overhang land area portions of each of the plurality of covered dimples is defined by a straight edge, wherein the straight edge of the internal surface and a tangent from a covered end point to a center of a bottom surface of the covered dimple defines an acute angle $\alpha$.

9. The golf ball according to claim 1 wherein each of the plurality of covered dimples has a five overhang land area portions.

10. The golf ball according to claim 1 wherein the number of dimples of the plurality of standard dimples is greater than the number of dimples of the plurality of covered dimples.

11. The golf ball according to claim 1 wherein the number of dimples of the plurality of covered dimples is greater than the number of dimples of the plurality of standard dimples.

12. The golf ball according to claim 1 further comprising land area.

13. The golf ball according to claim 12 wherein the plurality of covered dimples and the plurality of standard dimples have a combined golf ball surface area ranging from 70% to 95% of the entire golf ball surface area.

14. The golf ball according to claim 12 wherein the plurality of standard dimples have a combined golf ball surface area ranging from 50% to 85% of the entire golf ball surface area.

15. The golf ball according to claim 14 wherein the cover is composed of a material selected from the group consisting of ionomer, thermosetting polyurethane, thermoplastic polyurethane, balata, and mixtures thereof.

16. The golf ball according to claim 1 wherein the plurality of standard dimples comprises a first plurality of standard dimples having a first diameter, a second plurality of standard dimples having a second diameter greater than the first diameter, a third plurality of standard dimples having a third diameter greater than the second diameter, and a fourth plurality of standard dimples having a fourth diameter greater than the third diameter.

17. The golf ball according to claim 1 wherein the plurality of standard dimples comprises a plurality of pentagonal dimples.

18. The golf ball according to claim 1 wherein the golf ball has 10 covered dimples and 372 standard dimples.

19. A golf ball comprising:

a core;

a cover layer disposed over the core, the cover layer having a thickness ranging from 0.010 inch to 0.100 inch, the cover layer comprising a plurality of covered dimples, each of the plurality of covered dimples having a plurality of overhang land area portions covering a portion of a concavity of the covered dimple, and a plurality of standard dimples, each of the standard dimples having an entirely exposed concavity.

20. A golf ball comprising:

a core;

a boundary layer disposed over the core, the boundary layer composed of an ionomer material;

a cover layer disposed over the core, the cover layer having a thickness ranging from 0.010 inch to 0.100 inch, the cover layer composed of a polyurethane material, the cover layer comprising a plurality of covered dimples, each of the plurality of covered dimples having a plurality of overhang land area portions covering a portion of a concavity of the covered dimple, and a plurality of standard dimples, each of the standard dimples having an entirely exposed concavity.

* * * * *